US005181633A

United States Patent [19]

Weber et al.

[11] Patent Number: 5,181,633

[45] Date of Patent: Jan. 26, 1993

[54] CONTAINER FOR BULK MATERIAL WITH DISCHARGE CHUTE

[75] Inventors: Raymond Weber, Witten; Wolfgang Wünnenberg, Essen, both of Fed. Rep. of Germany

[73] Assignee: Bergwerksverband GmbH, Essen, Fed. Rep. of Germany

[21] Appl. No.: 691,055

[22] PCT Filed: Feb. 1, 1990

[86] PCT No.: PCT/EP90/00179

§ 371 Date: Jun. 21, 1991

§ 102(e) Date: Jun. 21, 1991

[87] PCT Pub. No.: WO90/08712

PCT Pub. Date: Aug. 9, 1990

[30] Foreign Application Priority Data

Feb. 2, 1989 [DE] Fed. Rep. of Germany ... 8901136[U]

[51] Int. Cl.[5] ..... B65G 69/06

[52] U.S. Cl. ..... 222/195; 222/564; 401/136

[58] Field of Search ..... 222/181, 185, 195, 198, 222/199, 564; 401/136, 137, 86

[56] References Cited

U.S. PATENT DOCUMENTS

| | | | |
|---|---|---|---|
| 4,382,723 | 5/1983 | Möller | 222/195 X |
| 4,793,529 | 12/1988 | Krauss et al. | 222/195 X |
| 4,854,722 | 8/1989 | Jackson | 222/564 X |
| 4,941,779 | 7/1990 | Dewitz et al. | 222/195 X |
| 4,970,830 | 11/1990 | Schlick | 406/136 X |
| 5,129,766 | 7/1992 | Dirkse et al. | 406/136 |

*Primary Examiner*—Gregory L. Huson
*Attorney, Agent, or Firm*—Herbert Dubno

[57] ABSTRACT

A container for bulk material includes a hollow glide body provided with inner walls forming an orifice opening into a bottom of the container, outer walls formed shorter than inner walls and a distribution cone formed with respective walls.

11 Claims, 7 Drawing Sheets

CONTAINER FOR BULK MATERIAL WITH DISCHARGE CHUTE

CROSS REFERENCE TO RELATED APPLICATIONS

This application is a national phase application of PCT/EP90/00179 filed Feb. 1, 1990, and based upon German application G 89 01 136.8 filed Feb. 2, 1989, under the International Convention.

FIELD OF THE INVENTION

Our present invention relates to a container for bulk material with discharge chute wherein a distribution cone is centrally arrayed and is surrounded by slide faces.

BACKGROUND OF THE INVENTION

In a known container ("Reisner et al., silos and bunkers for the storage of bulk materials, Trans Tech Publications 171, pages 90 and 91") for bulk material with a discharge chute, four inclined sliding plates are provided which are coordinated with a centrally arranged distributor cone. The inclination of the plates is chosen to be about 10% greater than the slope of the bulk material. The number of plates depends on the size of the container and the particle size of a bulk material. The distance between the plates corresponded to at least three times the maximal particle size of the bulk material. With this arrangement, a uniform settling of the bulk material lying thereabove could be accomplished. It has become evident, however, that in the known container for bulk material with a discharge chute the main problems, which arise in the handling of bulk materials, such as the blockage of the exit orifice due to bridging, the caking on the walls of the container, and the formation of dead zones, and thus a diminution of the effectiveness of the container, cannot be totally avoided.

OBJECTS OF THE INVENTION

It is the object of the invention to provide an improved container for bulk material with a discharge chute so that the formation of bridging above the exit orifice, caking on the container walls and formation of dead zones is reliably avoided and which, thereby overcomes drawbacks of the prior art.

SUMMARY OF THE INVENTION

According to the invention, a container includes a hollow glide body formed with inner walls forming an orifice opening into the bottom of the container, outer walls formed shorter than the inner walls, and a distribution cone formed with respective walls lying in a plane parallel to a plane in which inner and outer walls of the glide body lie. The cone is connected with the glide body. Thus the bulk material can be drawn down without any formation of depressions. The bulk material drops uniformly over the entire cross section of the container. This is particularly true for bulk material from the border areas, since a free slope angle of the bulk material can form below the hollow sliding bodies opening downwards. Such structure enables the sliding of the bulk material from the periphery, so that no compression will arise due to buildup of pressure. Uniformity of flow provided in the entire area of cross section avoids blockages of the exit orifices by bridging, as well as caking on the container walls, and the formation of dead zones.

Uniformity of the flow conditions can be further improved by exposing the hollow spaces of the glide bodies open towards the bottom to gas introduced as a means of fluidization. Due to the effect of fluidization, the internal friction of the bulk material particles is reduced.

The uniformity of flow conditions is achieved with cylindrical containers for bulk material with conical delivery chutes and inserted components as well as with containers for bulk material with rectangular or quadratic cross sections. The impairments usually arising in rectangular or quadratic containers in the areas of the wall angles of the discharge chute walls and leading to formation of dead zones, are not observed in embodiments according to the invention.

The inserted components are fixed in the discharge chute by means of brackets. Other fastening means as, for example, rope suspensions are also possible.

According to a further embodiment, the glide body for containers for bulk materials with cross flow, can be realized without an outer side all on the side of the gas exit, in a manner considering the changed behavior of the bulk material in a container for bulk material with gas stream from below.

In accordance with still another embodiment of the container for bulk material with discharge chute, the outer side walls on one or even more sides of a square or rectangular container can be realized in a slidable manner, e.g. by means of a slidable wall, in order to be able to control the behavior of the various bulk materials by means of lengthening o shortening of the outer side wall.

In the preferred embodiment, the distribution cone can be extended to a roof-shaped distribution cross open from below, into which the slide body is integrated, in order to attain an even better fluidization of the bulk material.

The invention is particularly advantageous for the following purposes:

adsorption container for the desulfurizing of flue gas, and the removal of nitrous oxide therefrom;

desorption container for the regeneration of adsorptive materials;

container for drying (e.g. of cereals).

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
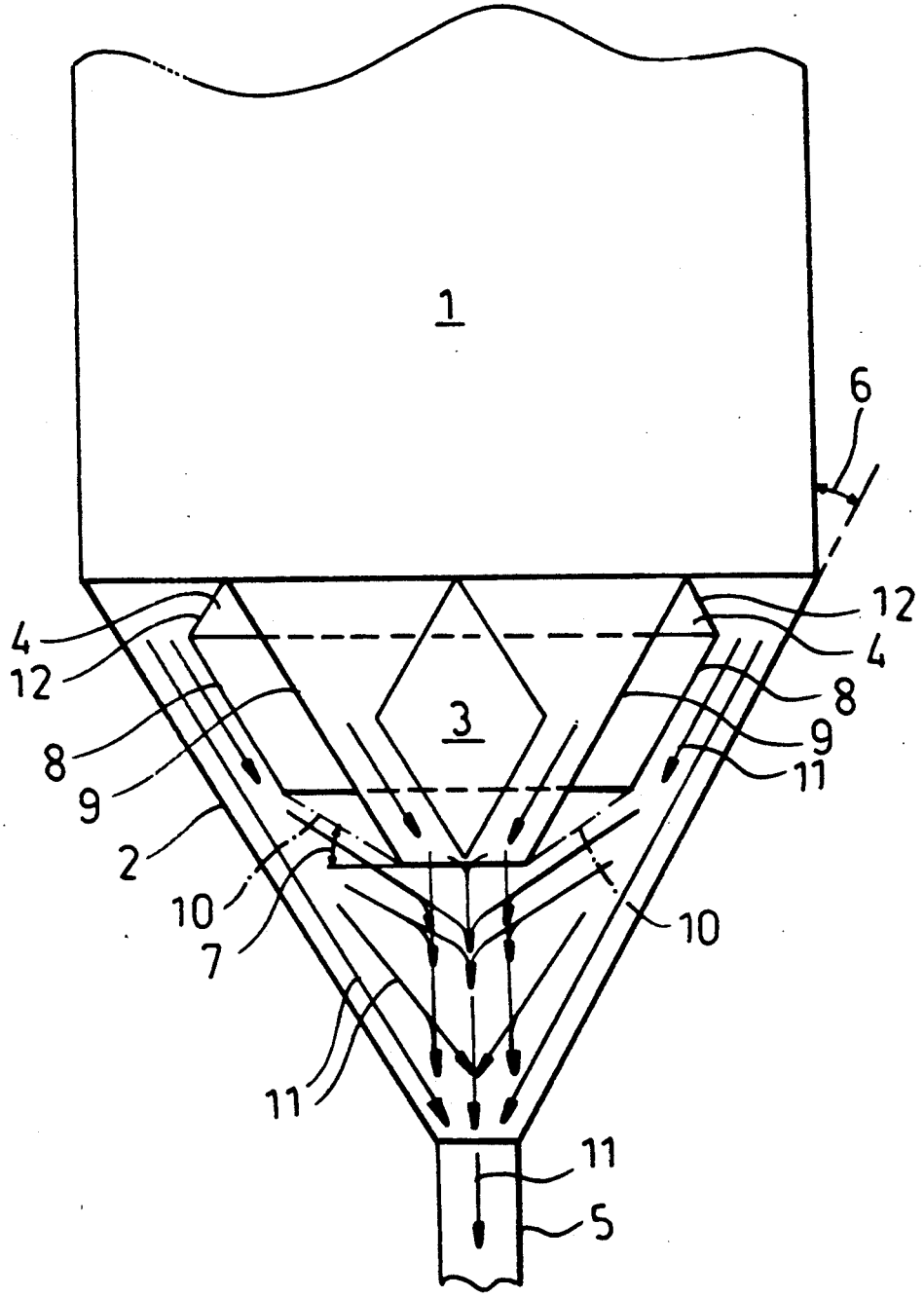
FIG. 1 is a longitudinal cross-sectional view of a cylinder-shaped container for bulk material with a cone-shaped discharge chute.
Figure 2:
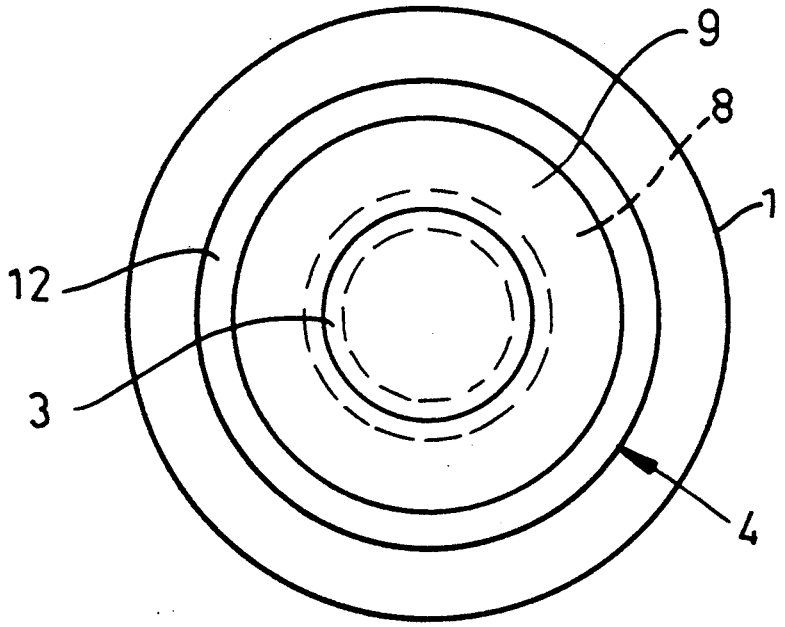
FIG. 2 is a transverse diagrammatic cross-sectional view according to FIG. 1.

FIGS. 1 and 2 show a cylindrical container 1 for bulk material according to the invention, to which is joined a conical discharge chute 2. In the discharge chute 2 is mounted a distribution cone 3, constructed as a double cone. A conical glide body 4 surrounds the centrally emplaced distribution cone 3 connected therewith by attachment elements to the glide body 4. The cone is also connected with the discharge chute 2.

The slide body 4 is designed as a hollow body which is enclosed by three surfaces, namely an outer side wall 8, an inner side wall 9 and an upper front wall 12. On the side opposite to the upper front wall, the glide body is open.

The walls 8, 9 and 12 as well as the limiting walls of the distributor cone 3 are aligned parallel to the wall of the discharge chute and thus have the same angle of inclination 6 shown in FIG. 1.

The bulk material is drawn out of the bulk material container 1 via a bulk material exit 5, whereby in the entire free cross sectional area an unimpeded flow of bulk material arises, as is shown by the flow direction arrow 11. On the open side of the glide body 4 the bulk material forms a slope 10 with the slope angle 7 corresponding to a difference in length between inner and outer walls of the slide body, it suffices as a rule that the glide body 4 is open from below, in order to attain a uniform withdrawal of the bulk material out of the bulk material container 1.

Figure 3:
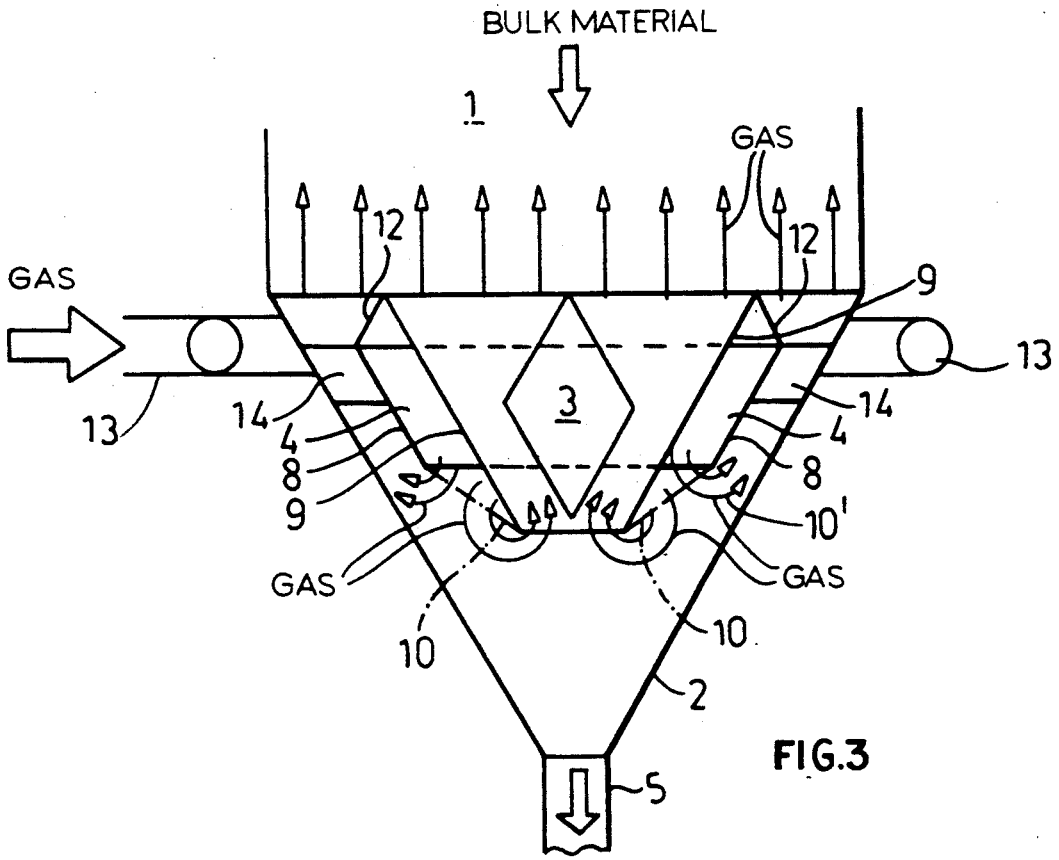
FIG. 3 is a longitudinal sectional view of a quadratic container according to the invention.
Figure 4:
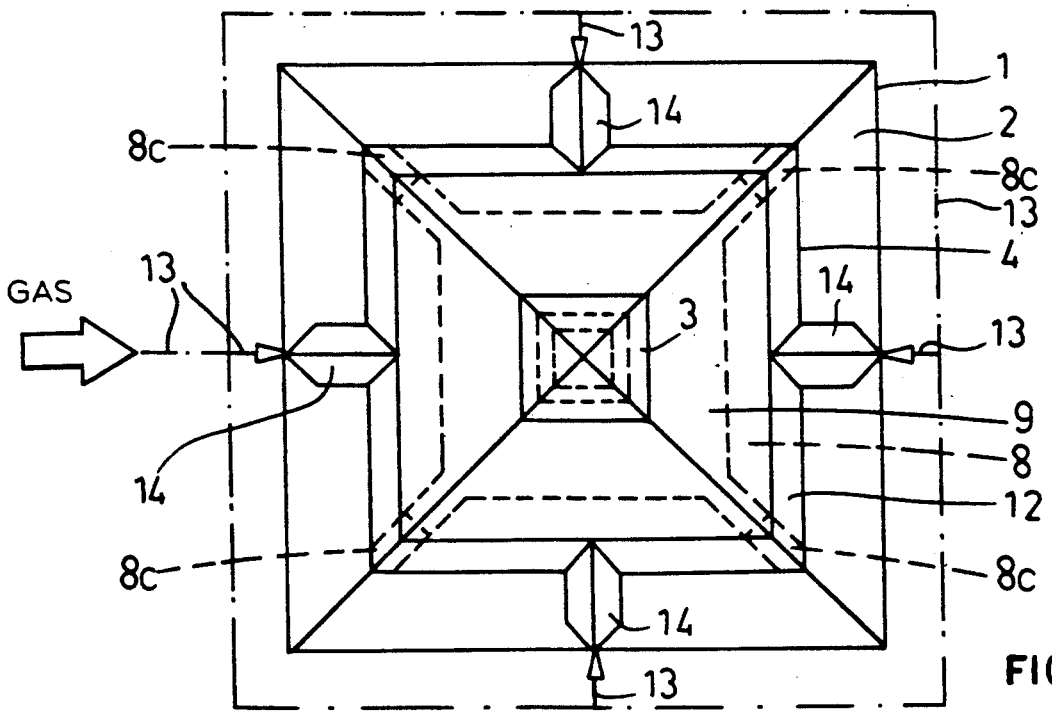
FIG. 4 is a transverse cross-sectional view of the embodiment shown in FIG. 3.

In FIGS. 3 and 4, a bulk material container with a square cross section is illustrated. In this embodiment, a gas line 13 is connected to the discharge chute 2 along a perimeter thereof. In the upper region of the four wall sides of the square discharge chute 2, fastenings 14 are provided centrally with perforated lines for gas line 13 connecting the chute to the glide body 4. As can be seen in FIG. 3, the gas issuing in the region of the slope 10 effects an improvement of the fluidization of the bulk material by means of the gas flow characterized by arrows 10'.

Figure 8:
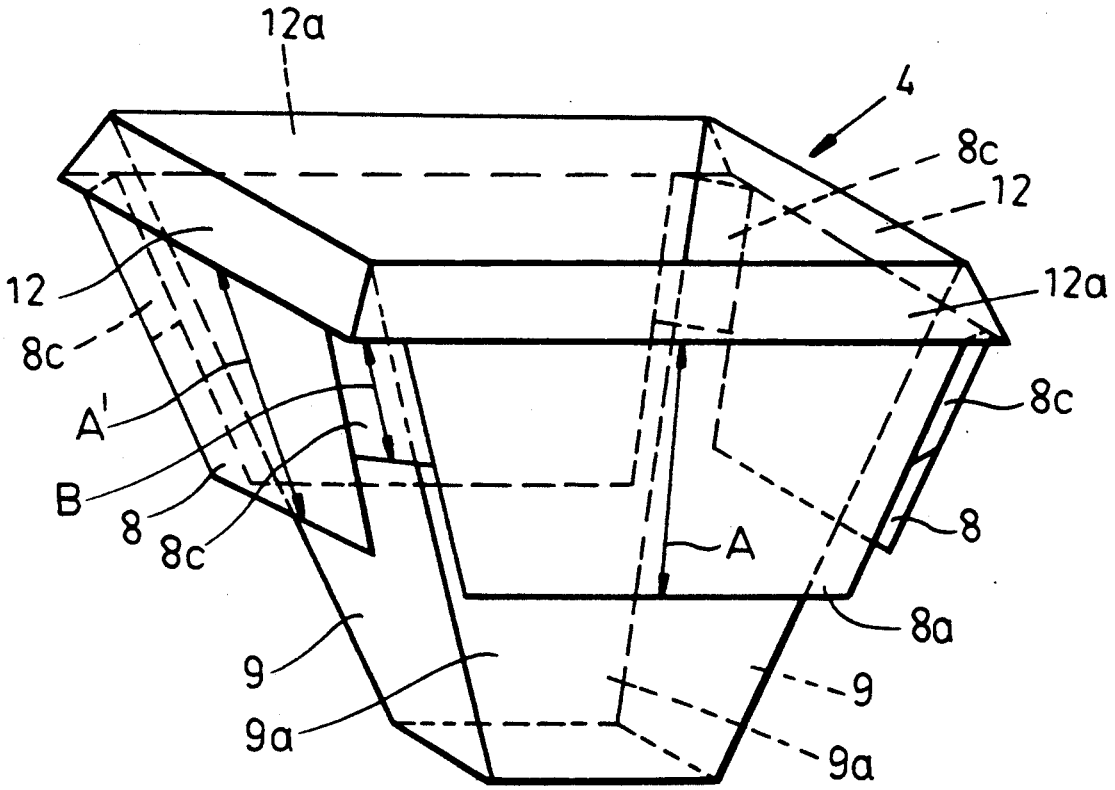
FIG. 8 is a perspective view of the glide body shown in FIG. 6.

The glide body 4 has, in accordance with the corresponding geometry of the square discharge chute, also a square cross-sectional shape with four outer side walls 8 and four inner side walls 9, which are connected via the four front walls 12. The outer side walls 8 are shorter than the inner side walls 9. In the corner regions, one each corner wall 8c (FIG. 4) can be provided, which connects two adjacent side walls 8 with one another and is shorter than they are (FIG. 8). The corner regions due to geometric conditions are inclined at a shallower angle of inclination 6 (FIG. 1) than the wall regions with respect to vertical.

Figure 5:
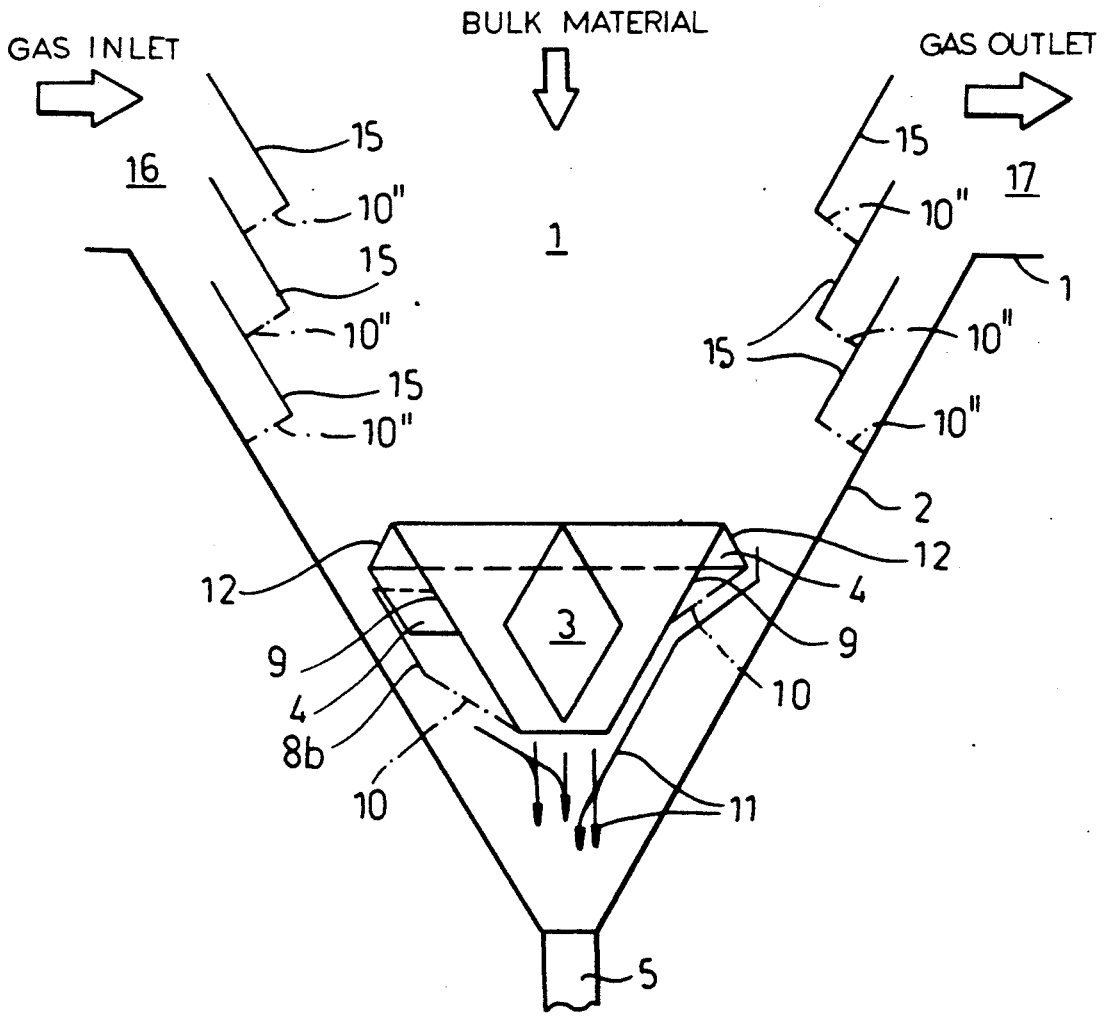
FIG. 5 is a longitudinal cross section through a container for bulk material with another embodiment of the glide body.

FIG. 5 shows a container for bulk material which is crossed laterally by a gas stream. The sideways gas volumes 16 or 17 on the gas inlet and outlet sides are separated from the bulk material by louvers 15. A slope 10" forms between the louvers 15.

In order to achieve a targeted exit of the bulk material, it is necessary in cross-streamed containers for bulk materials to omit the outer side wall 8 of the glide body 4 on the side of the gas outlet, as is shown in FIG. 5, or to make them shorter opposite the side wall 8 on the gas outlet side (not shown in the Figure). In such an embodiment the changed conditions of gas flow in a container traversed by gas flow for bulk material are taken in consideration in an optimal manner.

In order to determine the optimal length of the outer side wall 8 on the gas inlet side for a given bulk material, it is recommended to design the outer side wall 8 as an outer sliding wall 8b. The realization as sliding wall 8b is, however, not restricted only to a cross-streamed container for bulk material 1 but is also suitable as control element for a container for bulk material 1, where the gas is directed upwardly from below (e.g. according to FIG. 3).

Figure 6:
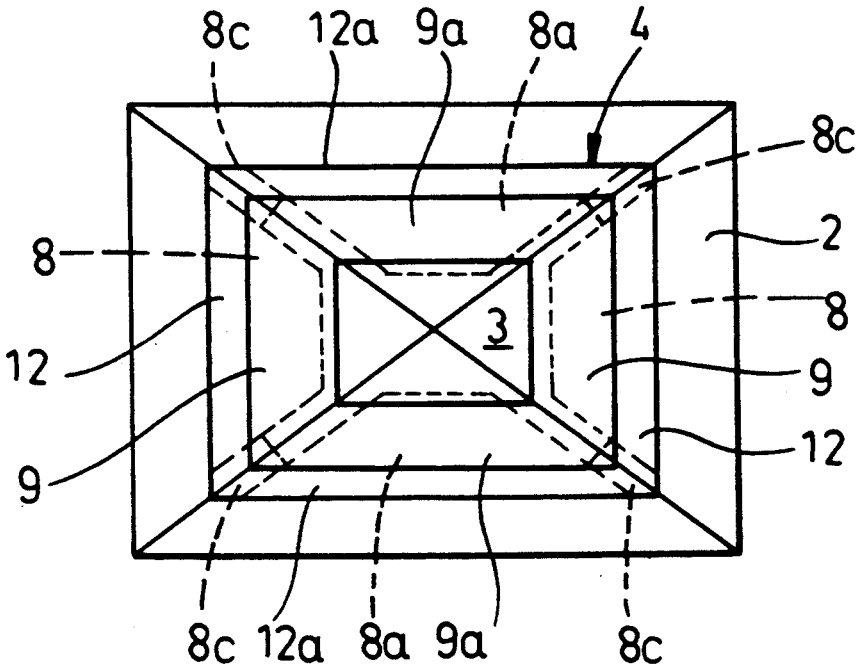
FIG. 6 is a diagrammatic transverse cross section of a delivery chute of a container for bulk material with rectangular cross section.
Figure 7:
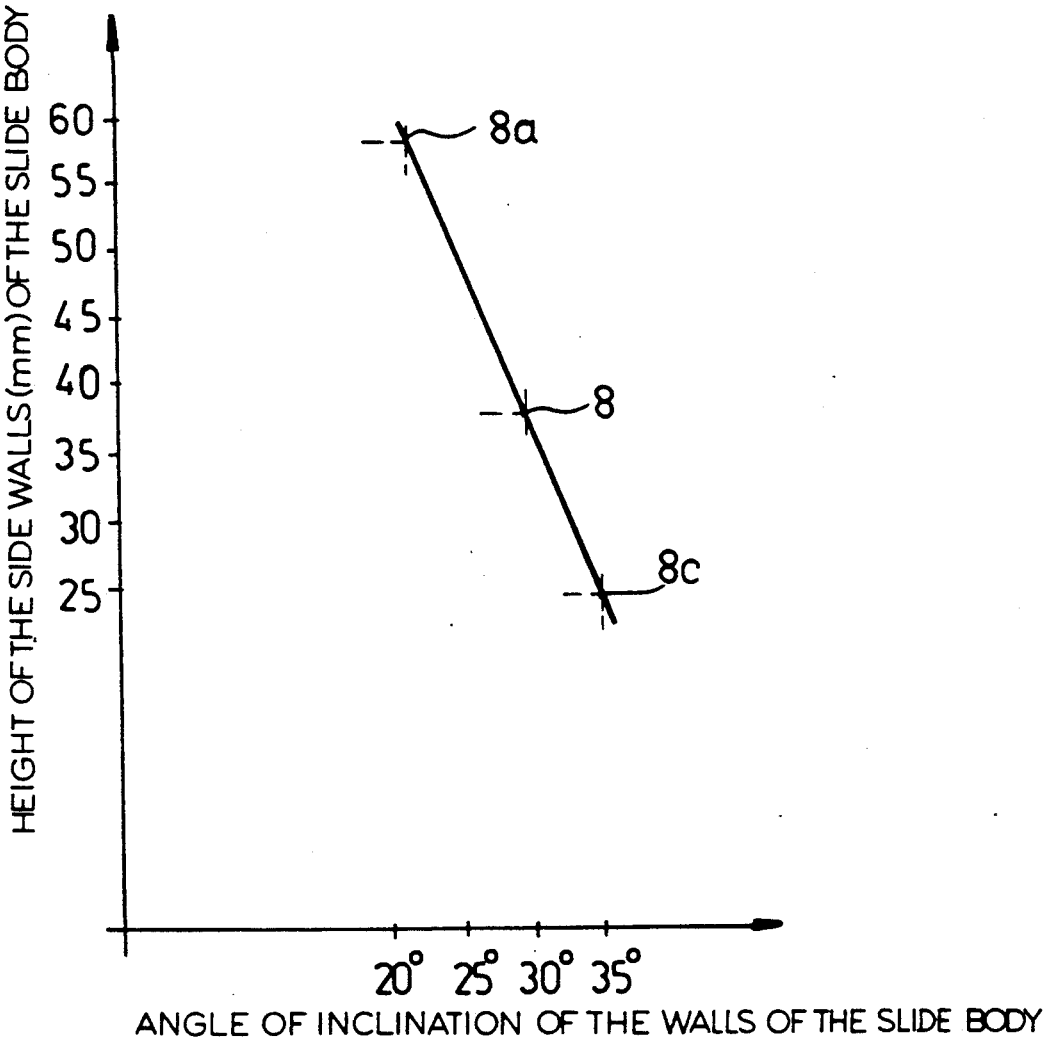
FIG. 7 is a diagram showing the dependence of the height of the side walls upon the angle of inclination thereof.

In FIG. 6, a discharge chute 2 of a container for bulk material 1 with rectangular cross section is shown in top view, where the lateral short walls of the slide body 4 are designated 8, 9 and 12, and the lateral long walls with 8a, 9a and 12a. Experiments have demonstrated that the outer side wall 8 is to be made shorter than the outer side wall 8a. In the corner areas, one each corner wall 8c is provided, which again is shorter than the side wall 8. In this case, as already mentioned, the condition is taken in consideration that, based on geometry, to any greater angle of inclination a smaller height of the side wall is corresponded. A diagram according to FIG. 7 shows values based on an experimental model.

FIG. 8 shows a slide body 4 for a container for bulk material 1 of rectangular cross section in a clear three-dimensional representation. It contains the characteristics for the designation of the heights of the outer side walls, specifically the height A corresponds to the outer side wall 8a, to the outer side wall 8—the height A', and to the corner wall—the height B.

Figure 9:
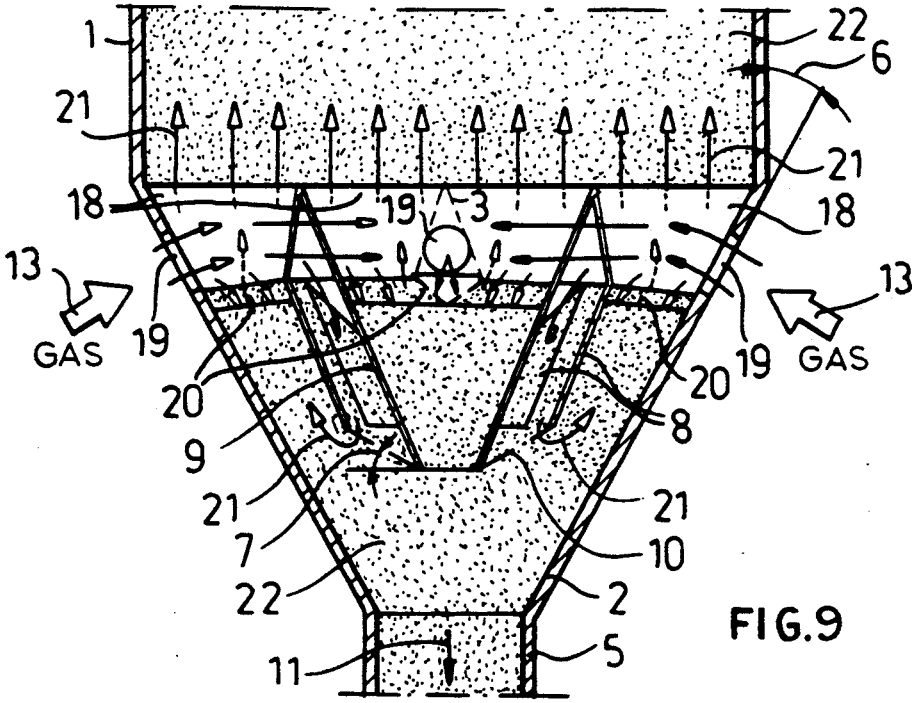
FIG. 9 is a longitudinal section of a quadratic container for bulk material.
Figure 10:
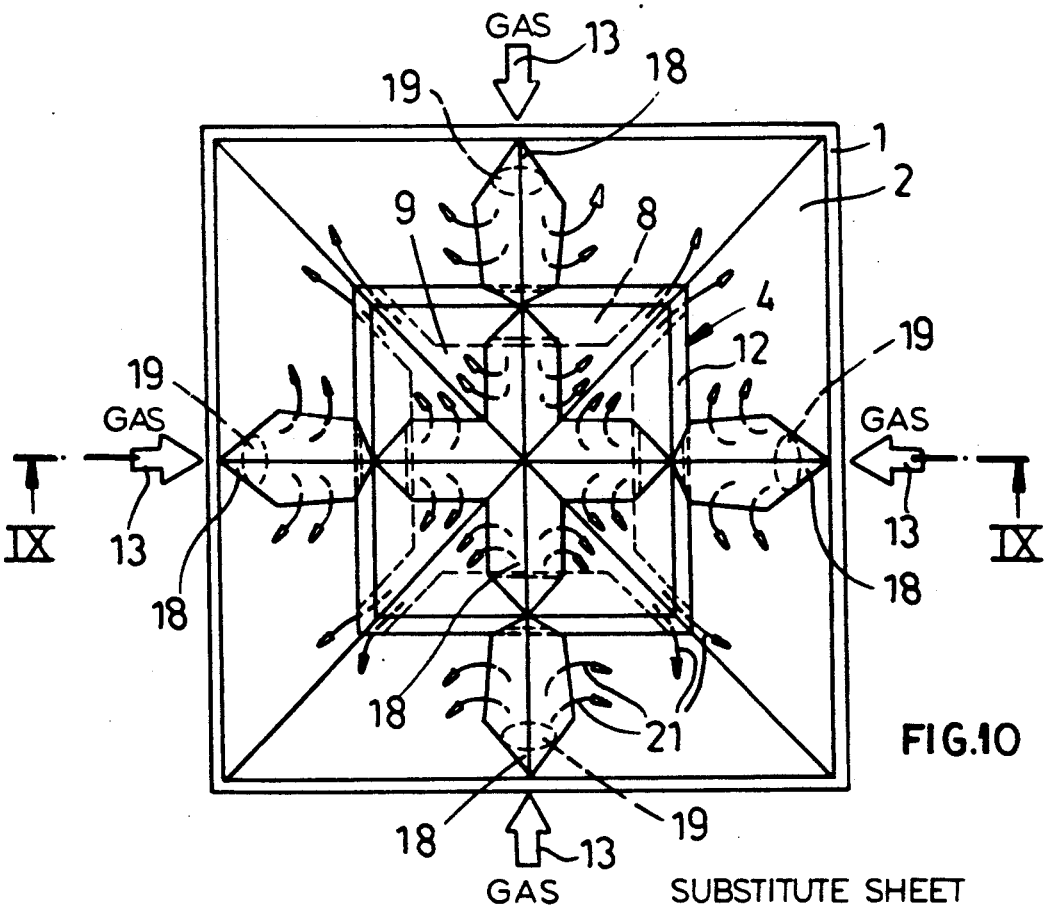
FIG. 10 is a top view of the embodiment shown in FIG. 9.

In the embodiment shown in FIGS. 9 and 10 the distribution cone 3 is further developed into a roof-shaped distribution cross 18, open towards the bottom, which is connected to glide body 4 and connects the ga inlets 19 to the discharge chute 2. In this manner, the area through which the gas, as shown by the stream arrows 21, can be conducted into the bulk material 22 in order to loosen it up and to improve its flow properties is increased. To the slope 10 below the glide body 4 is added the slope 20, which forms below the entire distribution cross 18 (FIG. 9).

EXAMPLE 1

A container for bulk material 1 with a discharge chute 2, which is equipped with a hollow glide body 4 and a distribution cone 3, according to the invention is constructed as a model made of plexiglass. It was a rectangular cross section and is conceived as a counterflow adsorber, i.e. the various bulk materials could be driven with as well as without a counterstream of air, whereby the air was admitted into the counterstream adsorber view the hollow glide body 4.

The dimensions of the model are the following:

The overall height is about 40 cm, whereof the discharge chute amounts to 13 cm. The length of the container is about 18 cm and the breadth about 12.5 cm.

The components mounted in the discharge chute 2 (glide body 4 and distribution cone 3) have a height of about 7 cm, a total width of about 8 cm and a total length of about 12.5 cm.

The outer side wall 8a has an angle of inclination of 21.5% and is about 6 cm high. The outer side wall 8 has an angle of inclination of 30° and is about 4 cm high and the corner wall 8c has an angle of inclination of 35° and was about 2.5 cm high.

The experiments were carried out with cylindrical bulk materials of varied size and different type:

| Type of material | Diameter (mm) | Length (mm) |
|---|---|---|
| Activated Coke | (D =)2.0 (mm) | (Length) = 3 (mm) |
| Zeolite | (D =)1.7 (mm) | (Length) = 2–4 (mm) |
| Granules of a Synthetic | (D =)2.0 (mm) | (Length) = 2 (mm) |

During draw-down of the various bulk materials from the discharge chute 5, which measured 2×2.5 cm, a steady mass flow arose over the entire cross-section of the model, i.e. the surface of the descending bulk material remained horizontal. In the region of the discharge chute 2 a steady mass flow is likewise accomplished over the entire area of cross section, which in the wall corners also does not show any dead zones over the entire region of the corner angle.

No differences could be observed in the flow behavior between the various bulk materials.

The same flow behavior is also evident when air is fed via glide body 4, which is important for counterflow adsorbers. No disruption of the uniform mass flow show 5' as long as the air velocity remains sufficiently below the velocity where a turbulent layer forms.

EXAMPLE 2

In a plexiglass model of quadratic cross section (FIGS. 9 and 10) and 100 cm side length, which is conceived as a counterflow adsorber, the distribution cone 3 is extended to a distribution cross 18. The free flow area for the gas could thereby be increased to 40% of the cross sectional area of the container.

The dimensions of the model were

Overall height = 2.37 m

Height, discharge chute = 0.60 m

Cross section = 0.81 $m^2$

The experiments are carried out with hearth oven coke.

The mean gas velocity, as referred to the free cross sectional area of the adsorber of 0.81 $m^2$ is increased stepwise from 0.2 m/s to 0.4 m/s.

At all velocities, a uniform gas distribution is observed about the entire cross section of the model. The mass flow was steady over the entire region of the cross section. In the wall corners too, no dead zones are observed.

We claim:

1. A container for bulk material comprising:

a container body;

a discharge chute extending downwardly from said body along an upright axis and formed with a peripheral wall and bottom means forming an exit for the bulk material;

a tapered distribution body centered on said axis in said chute;

a hollow glide body centered on said axis in said chute and surrounding said distribution body, said glide body comprising:

an inner wall spaced from said distribution body and formed with a bottom edge defining an outlet opening spaced axially upwardly from said exit, outer walls at least partially surrounding said inner wall, and a top wall bridging said inner and outer walls, said peripheral, inner, and outer walls being spaced from one another and being generally parallel to one another, said outer walls terminating at a distance above said bottom edge of said inner wall; and fastening means for mounting said distribution body and said hollow glide body on said chute.

2. The container defined in claim 1, further comprising delivering means including a gas line mounted on said peripheral wall of the chute for supplying a gaseous medium between said walls of said chute, outer walls of said glide body and said distribution body.

3. The container defined in claim 2 wherein said delivering means includes means forming a gas inlet and a gas outlet spaced from one another along inlet and outlet sides of the container, said glide body being formed only with the outer wall along said inlet side.

4. The container defined in claim 1 wherein said distribution and glide bodies have respective shape of cones.

5. The container defined in claim 1 wherein said distribution and glide bodies have respective rectangular cross-sections.

6. The container defined in claim 1 wherein said distribution and glide bodies have respective square cross-sections.

7. The container defined in claim 1 wherein said outer walls are slidable.

8. The container defined in claim 1 wherein said outer walls surrounding said inner walls are joined together by corner walls in respective corner regions guiding the bulk material.

9. The container defined in claim 8 wherein said inner, outer and corner walls have respective heights, said bulk material forming a slope angle corresponding to a difference between heights of said inner and outer walls, so that the less said heights of said outer walls of said glide body are the larger said slope angle is.

10. The container defined in claim 9 wherein the less respective heights of said corner walls are the larger said slope angle is.

11. The container defined in claim 2 wherein said distribution body is formed with four wings forming a cross-shaped distribution top receiving said gaseous medium, each of said wings bulging upwardly and being operatively connected with said glide body.

* * * * *